US007137838B2

(12) United States Patent
Koga

(10) Patent No.: US 7,137,838 B2
(45) Date of Patent: Nov. 21, 2006

(54) ELECTRIC CONNECTOR HAVING CONTACT FOR CONNECTION TO A FLAT, FLEXIBLE CABLE

(75) Inventor: Masahiro Koga, Kanagawa (JP)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/533,057

(22) PCT Filed: Oct. 31, 2003

(86) PCT No.: PCT/JP03/14002

§ 371 (c)(1),
(2), (4) Date: Oct. 17, 2005

(87) PCT Pub. No.: WO2004/040710

PCT Pub. Date: May 13, 2004

(65) Prior Publication Data

US 2006/0110965 A1 May 25, 2006

(30) Foreign Application Priority Data

Nov. 1, 2002 (JP) ..... 2002-320024

(51) Int. Cl.
*H01R 13/62* (2006.01)
*H01R 12/24* (2006.01)

(52) U.S. Cl. ..... 439/260; 439/492

(58) Field of Classification Search ..... 439/492, 439/67, 260, 261, 267, 357, 329
See application file for complete search history.

(56) References Cited

U.S. PATENT DOCUMENTS 5,240,430 A * 8/1993 Soes ..... 439/260
6,206,723 B1 * 3/2001 Kunishi ..... 439/495
6,726,497 B1 * 4/2004 Nogawa et al. ..... 439/260
6,837,740 B1 * 1/2005 Kunishi et al. ..... 439/495
6,884,108 B1 * 4/2005 Saito et al. ..... 439/495

FOREIGN PATENT DOCUMENTS

| | | |
|---|---|---|
| JP | 3-19279 | 10/1995 |
| JP | 2002-190360 | 7/2002 |
| JP | 2002-270290 | 9/2002 |

* cited by examiner

*Primary Examiner*—Chandrika Prasad
(74) *Attorney, Agent, or Firm*—Harrington & Smith, LLP

(57) ABSTRACT

A connector for gripping a flat flexible cable by elastically deforming two opposing contact beams is provided. The electrical connector for a flat flexible connector according to the present invention is such that in a contact portion in which two contact beams and a base beam holding them are integrally formed, the opposing free ends of the two contact beams are positioned so as to have points of contact with an FPC when the FPC is inserted, in the shape of their natural state without receiving any external forces, and by elastically deforming the other end of one of the contact beams while holding the FPC by means of stresses from the contact beams, further stress can be applied to the other contact beam, so as to achieve a firm grip on the FPC by support at three points at a rear end portion of one of the contact beams, the portion of attachment of the contact beams and the point of contact between the first contact beam and the FPC.

3 Claims, 4 Drawing Sheets

ELECTRIC CONNECTOR HAVING CONTACT FOR CONNECTION TO A FLAT, FLEXIBLE CABLE

TECHNICAL FIELD

The present invention concerns a connector for printed circuit boards for connecting printed circuit boards such as for flat flexible cables, or so-called FPC and the like.

BACKGROUND ART

An overview of connectors for printed circuit boards belonging to the conventional art shall be explained with reference to Japanese Utility Model Publication No. 3019279. As shown in FIG. 7 and FIG. 9, conventional electrical connectors for flat flexible cables are equipped with a cover (3) on the rear end upper portion of an insulated housing (1) that is rotatable in a forward and backward direction, and an engaging arm is equipped on the rear end portion of the base beam, and a series of lever arms (12) are provided on the rear end of the upper portion side of a U-shaped contact beam. An engaging portion comprising all of the engaging arms (19) of a plurality of conductive terminals (2) aligned in a row, and the engaging portion (16*a*, 17) of said cover mutually engage in such a manner that the cover is rotatable, and additionally, by opposing said lever arms and the rear end portion inner surface of the cover, the opening and closing of the opposing portions of the U-shaped contact beam is made possible by the rotation of the cover.

According to this structure, since the U-shaped second arm (8*b*) is fixed by the contact beam connecting portion and the front end portion support, the opening and closing of the opposing portions of the U-shaped contact beam is substantially done only by the lever arm of the first arm (8*a*) rear end. In the state wherein the cover (3) is flush on the body upper portion, and the opposing portions of each of the contact beam front ends are closed, when a FPC is inserted, said cover is opened and the first contact beam rear end is pushed downwards and said opposing portions are opened, and after insertion, the cover is closed and made flush to the initial body upper portion, and the FPC is gripped by returning said first arm to the initial state and closing the front end portions.

Among conventional structures that grip flat flexible cables (herebelow called FPC), for example, connectors that grip FPC's in various forms such as FIG. 4 of Japanese Unexamined Patent Publication No. 2002-190360, or FIG. 4 of Japanese Unexamined Patent Publication No. 2002-15826 have been suggested.

However, all of these connectors are in a form wherein the contact beams on one side gripping said FPC are affixed as the base portion, and gripping is done by elastically deforming the contact beams on the other side through an actuator. Therefore, since the FPC is gripped only by the elastic force of the contact beams of one side, if said elastic force is too strong, a strong force is required for the operating portion of the actuator, and if said elastic force is too weak, there is the disadvantage that it becomes easy for the FPC to slip out.

DISCLOSURE OF THE INVENTION

The present Applicant, in order to improve upon the aforementioned problem points, discovered that, in a contact portion in which two contact beams and a base beam holding them are integrally formed, by positioning the opposing free ends of the two contact beams so that, in the shape of their natural state without receiving any external forces, they have points of contact with an FPC when the FPC is inserted, and by elastically deforming the other end of one of the contact beams while holding the FPC by means of stresses from the contact beams, further stress can be applied to the other contact beam, so as to achieve a firm grip on the FPC. This shall be explained in detail below.

According to an embodiment of the present invention, the electrical connector of the present invention has a contact portion for holding a flat flexible cable and a body for accommodating said contact portion; the electrical connector being characterized in that said contact portion comprises:

- a first contact beam in contact with one surface of said flat flexible cable;
- a second contact beam in contact with the other surface of said flat flexible cable; and
- a base beam for affixing said contact portion to the body; wherein the ends of said first contact beam and said second contact beam on one side are free ends positioned in mutual opposition;
- the other end of said first contact is attached to said second contact beam;
- a rear end portion which is a free end is provided on the other end of said second contact beam;
- said second contact beam is connected to the base beam;
- said base beam comprises a structure affixed to the body;
- said body comprises an actuator which engages with said rear end portion and actuates said first and second contact beams;
- when said flat flexible cable is inserted into said contact portion in a natural shape in which no force is applied by said actuator, said first and second contact beams and said flat flexible cable have a portion of contact; and
- said actuator is capable of engaging with said rear end portion to elastically deform the first contact beam and second contact beam and to open and close the opposing free ends of the first and second contact beams.

If said contact portion is such that, when in a natural shape in which no external force is applied, the space between the free ends of said first and second contact beam is such that when a FPC is inserted, each of said contact beams inevitably come in contact with the inserted FPC, that is, during insertion, a resisting force is imparted by the FPC on each portion of contact, and it becomes possible to grip the FPC by the stress of the first contact beam. Additionally, since the front ends of each of the opposing contact beams are free ends, they are not fixed to the body, so each of said contact beams become capable of further free elastic deformation, and for example, gripping becomes possible during the insertion of a FPC that is compatible with cables of various thicknesses and the like. Further, by simultaneously elastically deforming the first contact beam and the second contact beam with the actuator, and closing the front ends of said opposing contact beams, a flat flexible cable can be gripped by three points of the contact, being the point between the first contact beam and the flat flexible cable, the attaching portion between the first and second contact beams, and said rear end portion, so stronger gripping becomes capable in comparison with the conventional art.

Another characteristic is that when said actuator engages with said rear end portion, moving said rear end portion upward with respect to the base beam and elastically deforming said second contact beam, said opposing free ends of the first and second contact beams are further closed.

When the actuator engages with said second contact beam rear end portion and elastically deforms a portion of said second contact beam upwards, a pressing force against the FPC is exerted on each of said portions of contact through the first contact beam, that is, a strong gripping force against the FPC can be obtained by the elastic force of said second contact beam rear end portion, the resisting force of the FPC against each of the contact beams, and the stress force from the first contact beam to the FPC.

Another characteristic is that when said actuator presses said rear end portion to the base beam side to elastically deform said second contact beam downward, the opposing free ends of the first and second contact beams are opened.

When inserting or removing a FPC, if the actuator presses said rear end portion to the base beam side, a portion of said second contact beam elastically deforms, and along with this, the free end of said first contact beam is positioned upwards. As a result, the free ends of each of said contact beams are opened, and the portions of contact with the FPC are released. Therefore, the insertion and removal of the FPC becomes easy.

EXPLANATION OF REFERENCE NUMBERS

Figure 1:
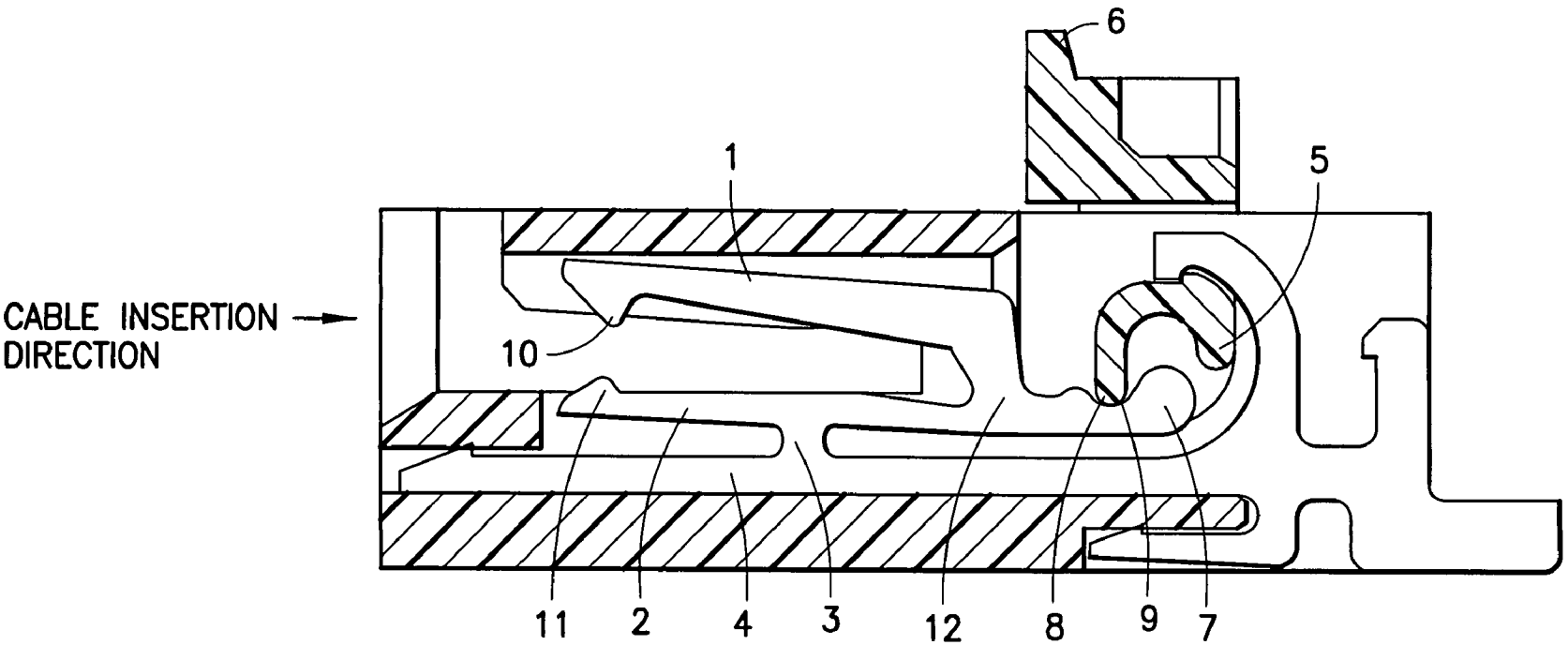
FIG. 1 is a sectional side view wherein the opposing contact beams of the connector of the present invention are opened.

1 . . . first contact beam
2 . . . second contact beam
3 . . . connecting portion
4 . . . base beam
5 . . . C-shaped actuator short protruding portion
6 . . . lid portion
7 . . . second contact beam rear end protruding portion
8 . . . C-shaped actuator long protruding portion
9 . . . second contact beam rear end depressed portion
10 . . . first contact beam contact point portion
11 . . . second contact beam contact point portion
12 . . . attaching portion of first contact beam and second contact beam

BEST MODE FOR EMBODYING THE INVENTION

FIG. 1 is a side sectional view of the electrical connector of the present invention, and is a figure showing the body and an integrated contact portion located therein in an open state. The structure of said contact portion shall be described. A first contact beam 1 and a second contact beam 2 formed in a U-shape capable of gripping a FPC is supported by a base beam 4 through a connecting portion 3 of the second contact beam 2 and the base beam 4. The rear end portion of said second contact beam 2 has a protruding portion 7 and a depressed portion 9 which respectively engage a short protruding portion 5 and a long protruding portion 8 of a C-shaped actuator. The front end on the side of the FPC insertion hole of said base portion 4 is locked and fixed to the body, and in the direction of the opposite end, an arc-shaped extending end connecting to said base portion anchors the actuator, and when the lid portion 6 is closed, said actuator rotates within said arc. Further, from the attaching portion of the rear end of said base portion 4, a reverse L-shaped beam that locks with a depressed portion of the body bottom portion of the connector, and an end portion of an L-shaped beam that locks in the end opposite to the insertion end of the connector body, and stretching to the rear end, is connected to a board by soldering or the like. When said lid portion 6 is completely released, the long protruding portion 8 of the C-shaped actuator presses the rear end depressed portion 9 of the second contact beam downward, elastically deforming the vicinity of the rear end of said contact beam, and as a result, opens the free end.

Figure 2:
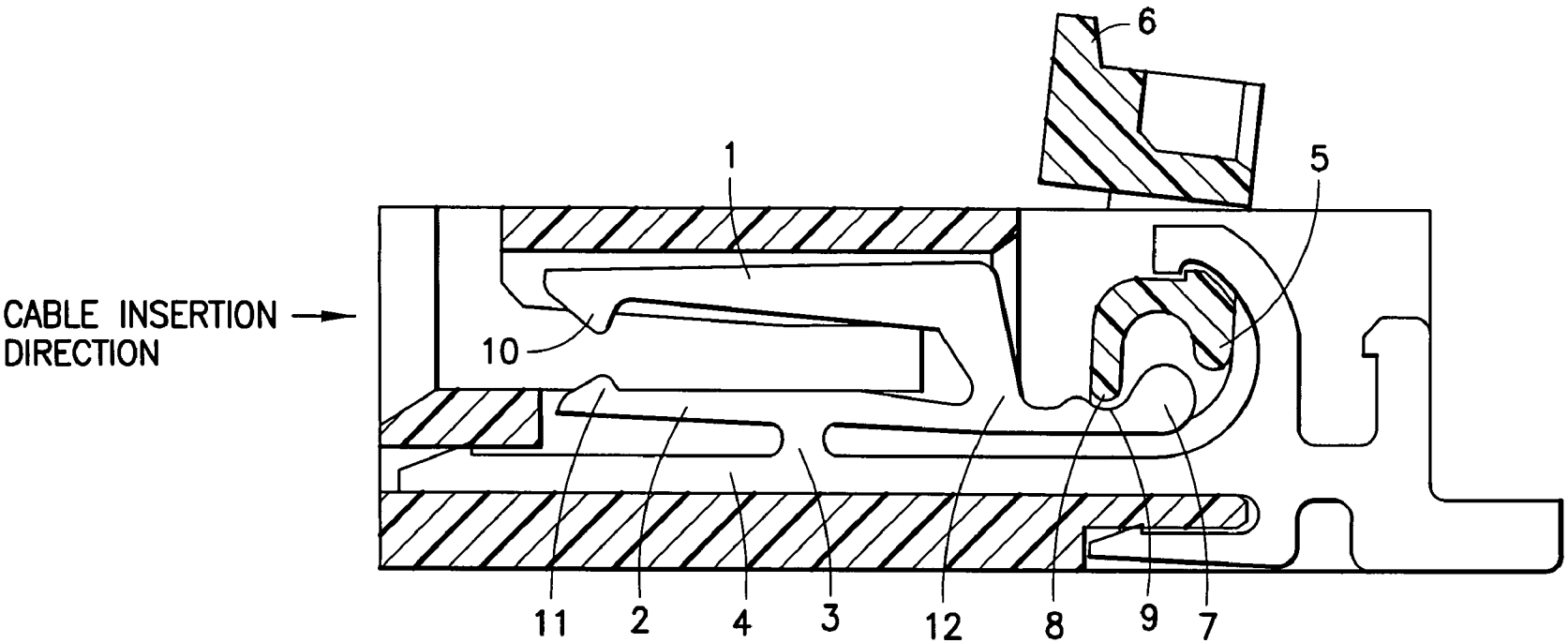
FIG. 2 is a sectional side view wherein the contact portion of the connector of the present invention is in a natural state in which no external force is applied.

FIG. 2 is similarly a side sectional view of the electrical connector of the present invention, and shows a figure wherein said lid portion 6 is starting the closing operation. The state is shown wherein the long protruding portion 8 of said actuator is releasing its engagement with said depressed portion 9, and the short protruding portion 5 of said actuator is in a state immediately prior to engaging said second contact beam rear end protruding portion 7. That is, said integral contact portion has no external force applied, and a natural state of the contact portion is shown. From the state of FIG. 1, the long protruding portion 8 of said C-shaped actuator releases its engagement with the second contact beam rear end depressed portion, and returns said second contact beam rear end which was elastically deformed by pressing to its initial position. By doing this, said first contact beam also returns to its initial position and each of the free ends of said U-shaped contact beams are closed.

After inserting a FPC with the front ends of each of the opposing contact beams open, when the engagement of the actuator is released and said integral contact portion is in a natural state in which no external force is applied (initial state), if it has a point of contact with the FPC, since the resisting force of said FPC works against the point of contact with said contact beam, the free ends of the opposing contact beams grip the FPC and are in a slightly more open state than said natural state.

Since said integral contact portion comprises the identical conducting material, if each of the points of contact on each of the contact beams (point of contact portion 10 (upper point of contact) of the first contact beam and point of contact portion 11 (lower contact point) of the second contact beam) are in contact with at least one of either the upper surface or the lower surface of the FPC, this will be compatible with cases wherein there is a point of contact with either surface of the FPC.

Figure 3:
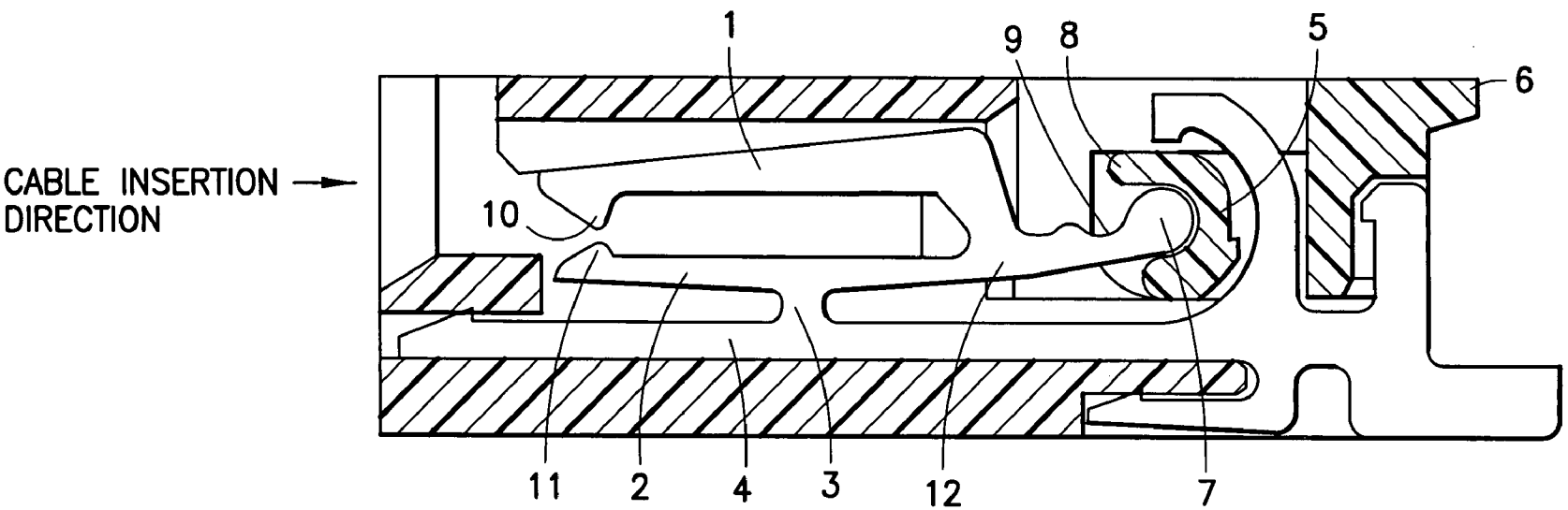
FIG. 3 is a sectional side view wherein the contact beam front ends of the connector of the present invention are closed.
Figure 4A:
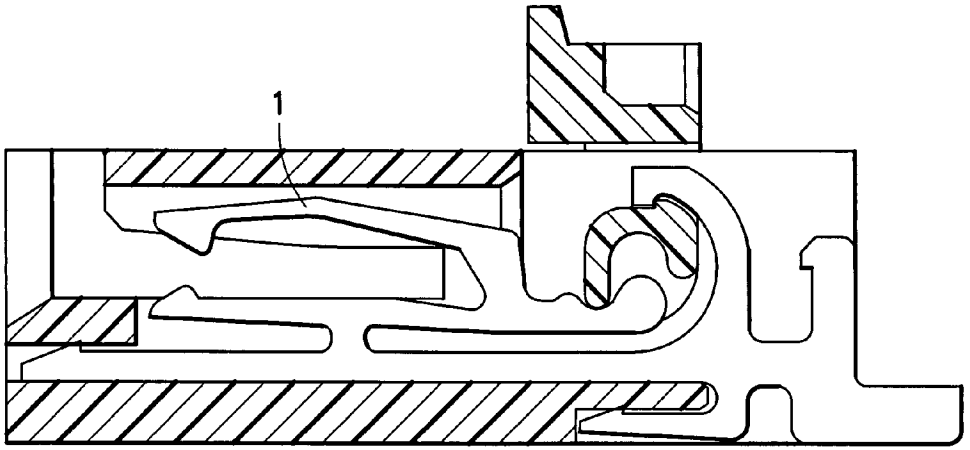
FIG. 4 is a sectional side view showing a variant example of the shape of the first contact beam in the contact portion in FIG. 1 of the connector of the present invention.
Figure 4B:
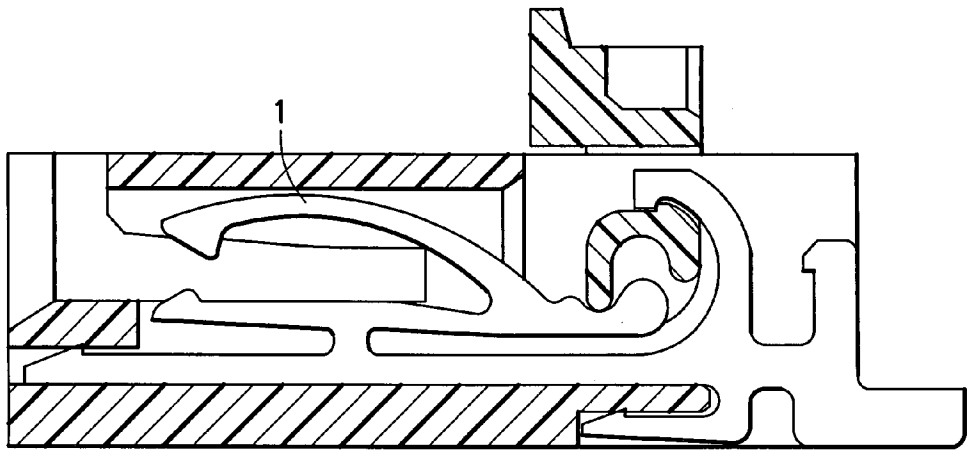

FIG. 3 is similarly a side sectional view of the electrical connector of the present invention, and shows a figure wherein the lid portion 6 is completely closed so that it is flush with the upper portion of the body. Said short protruding portion 5 of the actuator slides between said second contact beam rear end protruding portion 7 and the base beam 4, and pulls said protruding portion 7 upward. As a result, said second contact beam is elastically deformed upwards, and at the same time, the attaching portion 12 of each of the U-shaped contact beams move upward as well, so an elastic stress in a downward direction is generated in the free end of the first contact beam. That is, it is shown that further stress is applied to the state of FIG. 2 wherein a FPC is gripped, and a stronger grip is realized, so that a stronger gripping force is realized in comparison to the above-described gripping method of the conventional art. FIG. 4 shows variant examples of the shape of the first contact beam. An "upside-down V shaped" type or an "arc-shaped" type as shown in FIG. 4 may be used as the shape of the first contact beam, and similar results to those described above may be obtained.

The structure and operation of the present invention are as given above, but the present invention is not restricted to the present embodiment, and, for example, a structure wherein each of the free ends of the first beam and the second beam are in mutual contact in a natural state is included in the present invention. Additionally, since the present invention is characterized by being a structure wherein the second contact beam can move freely, any shape is included in the present invention as long as it is not fixed to the operating body, without restriction to the present embodiment.

In comparison to the conventional method of gripping by the opening and closing operation of one contact beam, with the shape of the contact portion of the electrical connector according to the present invention, by contacting on three points being the rear end portion 7 of the second contact beam, the attaching portion 12 of each of the U-shaped contact beams, and the point of contact 10 between the first contact beam and the FPC, a stronger grip becomes possible.

The invention claimed is:

1. An electrical connector for holding a flat flexible cable, said connector having a contact portion for holding said flat flexible cable and a body for accommodating said contact portion; the electrical connector being characterized in that said contact portion comprises:

a first contact beam in contact with one surface of said flat flexible cable;

a second contact beam in contact with the other surface of said flat flexible cable; and a base beam for affixing said contact portion to the body; wherein the ends of said first contact beam and said second contact beam on one side are free ends positioned in mutual opposition;

the other end of said first contact is attached to said second contact beam;

a rear end portion which is a free end is provided on the other end of said second contact beam;

said second contact beam is connected to the base beam;

said base beam comprises a structure affixed to the body;

said body comprises an actuator which engages with said rear end portion and actuates said first and second contact beams;

when said flat flexible cable is inserted into said contact portion in a natural shape in which no force is applied by said actuator, said first and second contact beams and said flat flexible cable have a portion of contact; and said actuator is capable of engaging with said rear end portion to elastically deform the first contact beam and second contact beam and to close the opposing free ends of the first and second contact beams.

2. An electrical connector as recited in claim 1, characterized in that when said actuator engages with said rear end portion, moving said rear end portion upward with respect to the base beam and elastically deforming said second contact beam, said opposing free ends of the first and second contact beams are further closed.

3. An electrical connector as recited in claim 1, wherein when said actuator presses said rear end portion to the base beam side to elastically deform said second contact beam downward, the opposing free ends of the first and second contact beams are opened.

* * * * *